US007481496B2

(12) United States Patent
Smith

(10) Patent No.: US 7,481,496 B2
(45) Date of Patent: Jan. 27, 2009

(54) MODULAR FURNITURE SYSTEM

(75) Inventor: Craig Alun Smith, Winnipeg (CA)

(73) Assignee: 5630372 Manitoba Inc., Winnipeg (CA)

( * ) Notice: Subject to any disclaimer, the term of this patent is extended or adjusted under 35 U.S.C. 154(b) by 0 days.

(21) Appl. No.: 11/750,136

(22) Filed: May 17, 2007

(65) Prior Publication Data

US 2008/0284228 A1 Nov. 20, 2008

(51) Int. Cl.
*A47C 7/00* (2006.01)

(52) U.S. Cl. ..... 297/440.14; 297/440.1

(58) Field of Classification Search ..... 297/440.1, 297/440.14

See application file for complete search history.

(56) References Cited

U.S. PATENT DOCUMENTS 3,093,410 A * 6/1963 Wilson ..... 297/248 X
3,412,502 A * 11/1968 Riches ..... 297/239 X
3,529,879 A * 9/1970 Priest ..... 312/111
3,669,494 A * 6/1972 Lohmeyer ..... 297/440.14
3,773,329 A * 11/1973 Secter ..... 297/440.14 X
3,811,728 A * 5/1974 Redemske ..... 297/440.14
3,944,281 A * 3/1976 Piretti ..... 297/440.14
4,077,666 A * 3/1978 Heumann ..... 297/440.14
5,423,597 A * 6/1995 Rogers ..... 297/440.1
6,296,314 B1 * 10/2001 Klein ..... 297/440.14
7,014,267 B1 * 3/2006 Nagar ..... 297/440.14
7,020,911 B2 * 4/2006 Oldham ..... 297/440.1 X
7,213,885 B2 * 5/2007 White et al. ..... 297/440.1
7,322,642 B2 * 1/2008 BoJack ..... 297/440.14 X
2007/0257539 A1 * 11/2007 White et al. ..... 297/440.14

* cited by examiner

*Primary Examiner*—Rodney B. White
(74) *Attorney, Agent, or Firm*—Ade & Company Inc; Kyle R. Satterthwarte; Ryan W. Dupuis

(57) ABSTRACT

A modular furniture system comprises a frame adapted to define a plurality of engagement sites and a plurality of components removably engagable to the frame at the plurality of engagement sites to define a piece of furniture. Each component is engagable to the frame at different positions thereon to facilitate a change in shape of the piece of furniture by rearrangement of the plurality of components relative to one another. The plurality of components are shaped and sized to be groupable together into a storage configuration when not engaged to the frame. In the storage configuration, the components are enclosable in a rectangular volume of lesser size than when engaged to the frame. Each component comprises a core body and a removable cover that shrouds the core with the plurality of components engaged to the base.

19 Claims, 12 Drawing Sheets

A
B
A
B
24
26
26a
28
28a
36
36a
36b
38
34
34a
40
22
24a

MODULAR FURNITURE SYSTEM

This invention relates generally to modular furniture systems and more particularly to a modular furniture system having a base or frame upon which a number of components are removably mountable.

BACKGROUND OF THE INVENTION

Conventional furniture, whether provided to the consumer in completed or modular form, tends to be quite limited in its appearance and function do to limitations in its structure. For example, a conventional one-piece sofa purchased as an assembled unit has a fixed appearance that, while it can be modified through potentially costly reupholstering to change the color or pattern should the owner decide a change in appearance is warranted, is limited to the same general overall shape. Modular seating systems are known which allow expansion by adding additional seating units to the structure, but the added units produced by the manufacturer may be substantially equal in appearance to the other units of the structure. Furthermore, once an additional seating unit is incorporated into the modular system, each unit may still limited in that alteration of that unit's appearance will likely require significant cost or effort, for example to reupholster the unit to change its color or pattern.

Furthermore, conventional furniture assembled furniture is bulky and thus awkward and costly to transport. Even conventional modular furniture shipped as packaged unassembled components may take up a significant volume of space overall, for example due to components having uncomplimentary shapes that do not bundle well into a compact configuration, even though the components are each individually smaller and easier to handle than the resulting piece of assembled furniture, and thus may still be costly to ship. Empty space within shipping containers increases fuel consumption, as the number of articles transportable within a single vessel at one time is decreased.

It is therefore desirable to provide a modular furniture system that facilitates relatively easy changes in appearance and can be packed into a volume reduced from that of the resulting product to lower shipping costs.

SUMMARY OF THE INVENTION

According to a first aspect of the invention there is provided a modular furniture system comprising:

a frame adapted to define a plurality of engagement sites; and a plurality of components removably engagable to the frame at the plurality of engagement sites to define a piece of furniture, each component being engagable to the frame at different positions thereon to facilitate a change in shape of the piece of furniture by rearrangement of the plurality of components relative to one another.

Unlike prior art modular furniture systems wherein each component of the system is designed to engage with another component in a predetermined position and orientation relative thereto to produce a piece of furniture of predetermined shape, the components of the components of the preferred embodiment of the present invention can be attached to the base in different positions relative to the base and to one another to allow easy alteration of the furniture's shape to change the appearance or functionality thereof.

Preferably each component is engagable to the frame at different orientations relative thereto.

Preferably the frame is adapted to define a two-dimensional array of engagement sites.

Preferably the two dimensional array of engagement sites is rectangular and each component is adapted to engage the frame at multiple engagement sites, the multiple engagement sites equaling a row of the two dimensional array in number of engagement sites.

Preferably at least some of the plurality of components are each generally L-shaped to define a base portion adapted to extend along the frame when connected thereto and a second portion projecting from the base portion to extend away from the frame when connected thereto. L-shaped components provide a high-degree of adjustability in the shape of the furniture, as changing the positions and orientations of the L-shaped portions relative to the base will change the locations on the base at which the second portions project upward. For example, an L-shaped component can be used to create seating surfaces atop the base with one leg and an armrest or seatback projecting upward from the seating surface with the other leg.

Preferably at least some of the components comprise cushioned portions to collectively define a seat when connected to the frame adjacent one another.

Preferably at least one of the components comprises a tabletop.

Preferably the frame comprises a plurality of frame members selectively engagable together to support the plurality of components at the plurality of engagement sites.

Preferably the plurality of frame members are adapted for engagement together in a grid formation in which the frame members extend upward to intersections between crossing frame members to define cross-shaped projections over which corresponding cross-shaped slots in the plurality of components can be slid to engage with the frame.

According to a second aspect of the invention there is provided a modular furniture system comprising:

a frame adapted to define a plurality of engagement sites; and a plurality of components removably engagable to the frame at the plurality of engagement sites in a seat-forming configuration to define a seat atop the frame, the plurality of components being shaped and sized to be groupable together into a storage configuration when not engaged to the frame, the plurality of components when in the storage configuration being enclosable in a rectangular volume of lesser size than required to enclose the plurality of components when in the seat-forming configuration.

Preferably the plurality of components comprises L-shaped components each having a base portion and a second portion projecting therefrom, the base portions of the L-shaped components being equal in length and the second portions of the L-shaped components being equal in length.

Preferably each L-shaped component comprises flat sides to facilitate stacking of layers of the L-shaped components.

Preferably the plurality of components comprise flat faces to facilitate flush face-to-face arrangement of the components in the storage configuration.

Preferably exterior faces of each component are flat and perpendicular to one another to facilitate flush face-to-face arrangement of the components in the storage configuration.

Preferably the components are arrangable into stacked layers in the storage configuration, the stacked layers defining a stack having a cylindrical outer periphery.

Preferably the stack is cubical.

Equally sized L-shaped components having flat and perpendicular external faces can be laid on their sides with the end of one leg of each L-shaped component sitting flush against a side of the opposite leg of the other L-shaped component to create a rectangular layer with a rectangular hole in the center. These layers can be stacked atop one another, and may be stacked with other rectangular layers formed by rectangular components.

According to a second aspect of the invention there is provided a modular furniture system comprising:

a frame adapted to define a plurality of engagement sites; and a plurality of components removably engagable to the frame at the plurality of engagement sites in a seat-forming configuration to define a seat atop the frame, each component comprising a core body and a removable cover that shrouds the core with the plurality of components in the seat-forming configuration.

Having a removable cover on each components allows alteration of the furniture's appearance by replacement of the cover with one of a different fabric, color, pattern, thickness or shape. This also allows easy replacement of one or more worn cover, without necessarily requiring reupholstering of the entire furniture article. A supplier could stock multiple styles of covers to allow owners to purchase varieties of covers or to trade-in or recycle one style of cover for another.

Preferably the cover comprises an inner padding layer adjacent the core and an outer layer disposed on a side of the inner padding layer opposite the core, the inner padding layer and the outer layer being separable from one another.

Preferably the inner padding layer is formed to define a hollow interior similar in shape to the core.

Preferably the cover has a hollow interior and is open at an end thereof to fit over the core.

BRIEF DESCRIPTION OF THE DRAWINGS

In the accompanying drawings, which illustrate an exemplary embodiment of the present invention.

DETAILED DESCRIPTION

Figure 1:
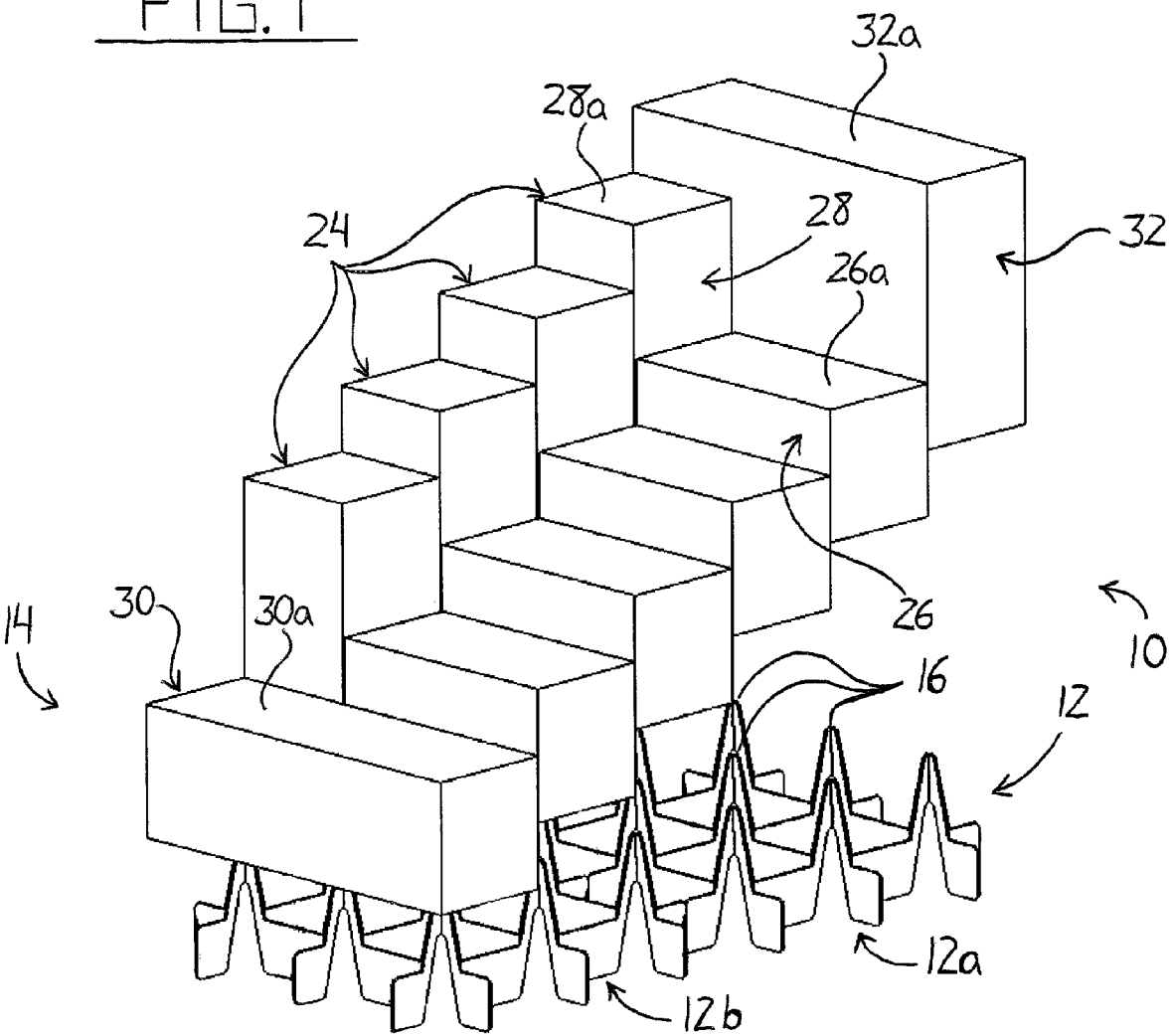
FIG. 1 is an exploded perspective view of a modular furniture system.

FIG. 1 shows a modular furniture system 10 according to the present invention. The system 10 features a grid-like base frame 12 atop which a plurality of support-surface components 14 can be engaged to the frame in a variety of different positions and orientations relative to one another so as give the owner of the system control over the overall shape of the piece of furniture to be formed by the system 10. The base 12 defines a two-dimensional rectangular array of engagement sites, at each of which one of the plurality of surface components 14 engages the frame 12. Each engagement site is defined by a projection 16 formed at the intersection of frame members defining the grid like base frame 12. A linear array of slots extend into each of the plurality of surface components 14 from a bottom surface thereof to receive respective ones of the upward extending projections 16 within the rectangular array of engagement sites provided by the base 12. The slots and projections are shaped to allow one of the plurality of support-surface components to be lowered over any one projection in any one of four possible orientations spaced ninety degrees about a longitudinal axis of the projection. In other words, a component can be engaged to a projection for mounting on the base frame to extend along either a row or a column of the array of engagement sites in which the projection is located and in either direction along this row or column.

Figure 2:
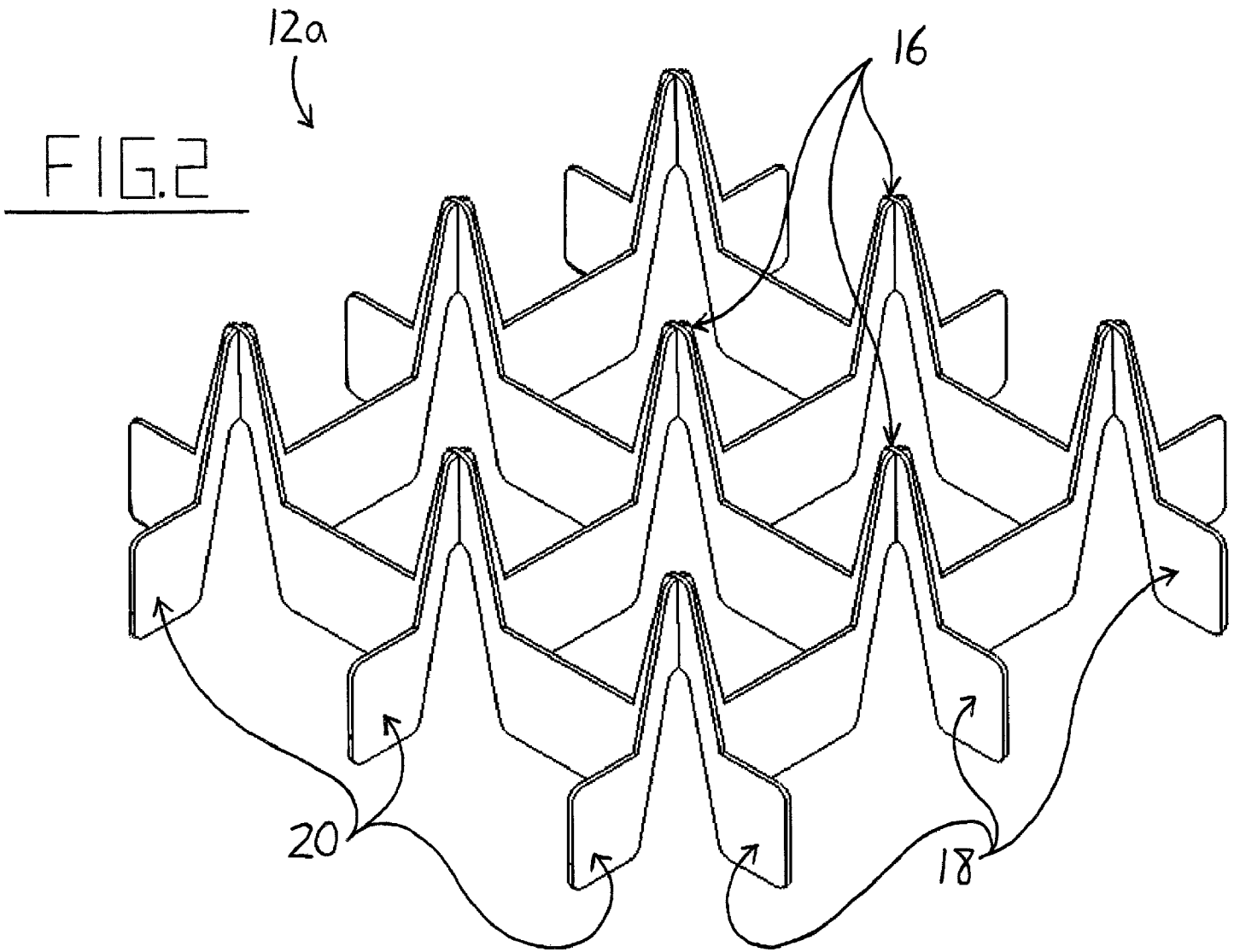
FIG. 2 is a perspective view of a frame section of the modular furniture system.
Figure 3:
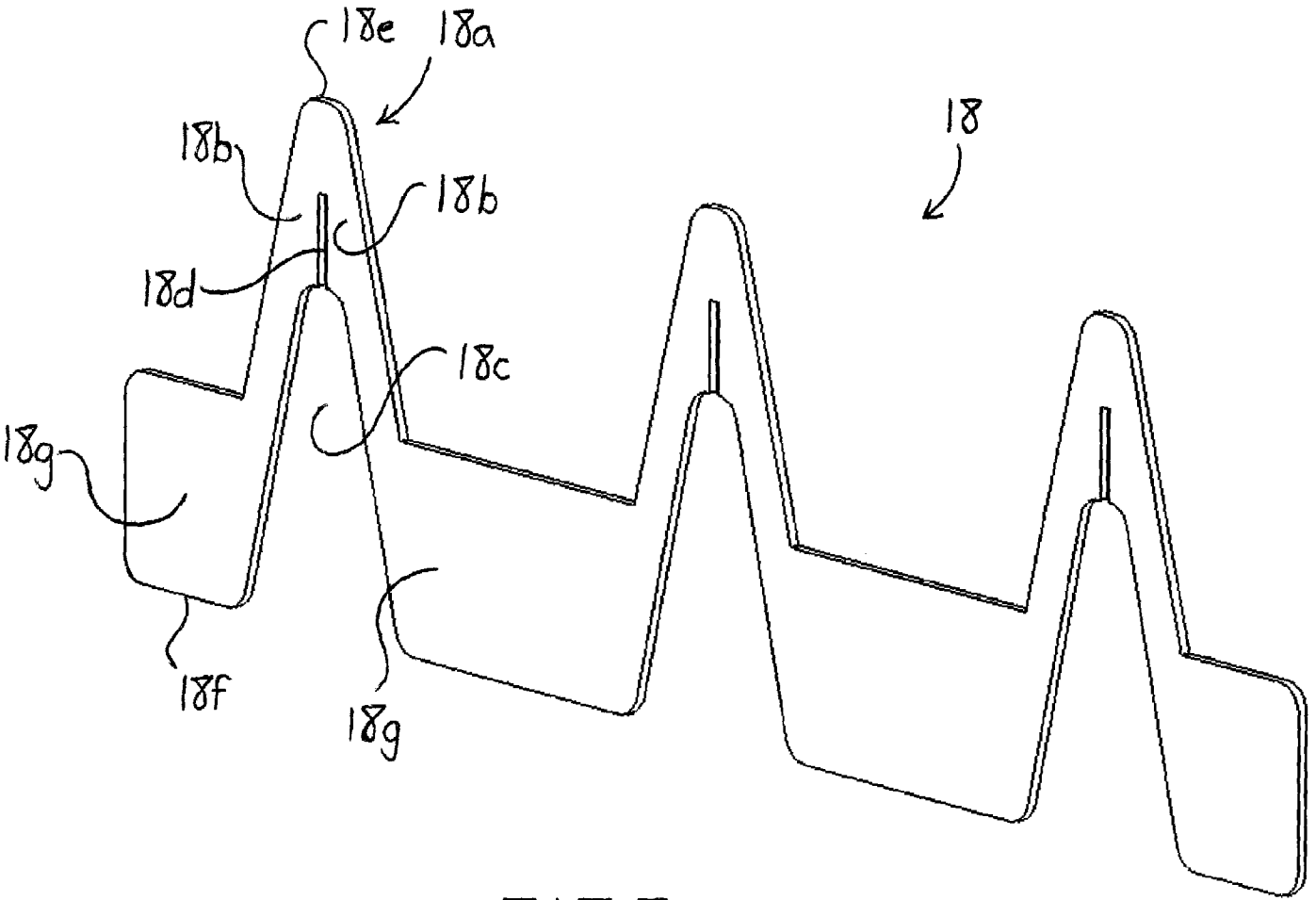
FIG. 3 is a perspective view of a first frame member of the modular furniture system.
Figure 4:
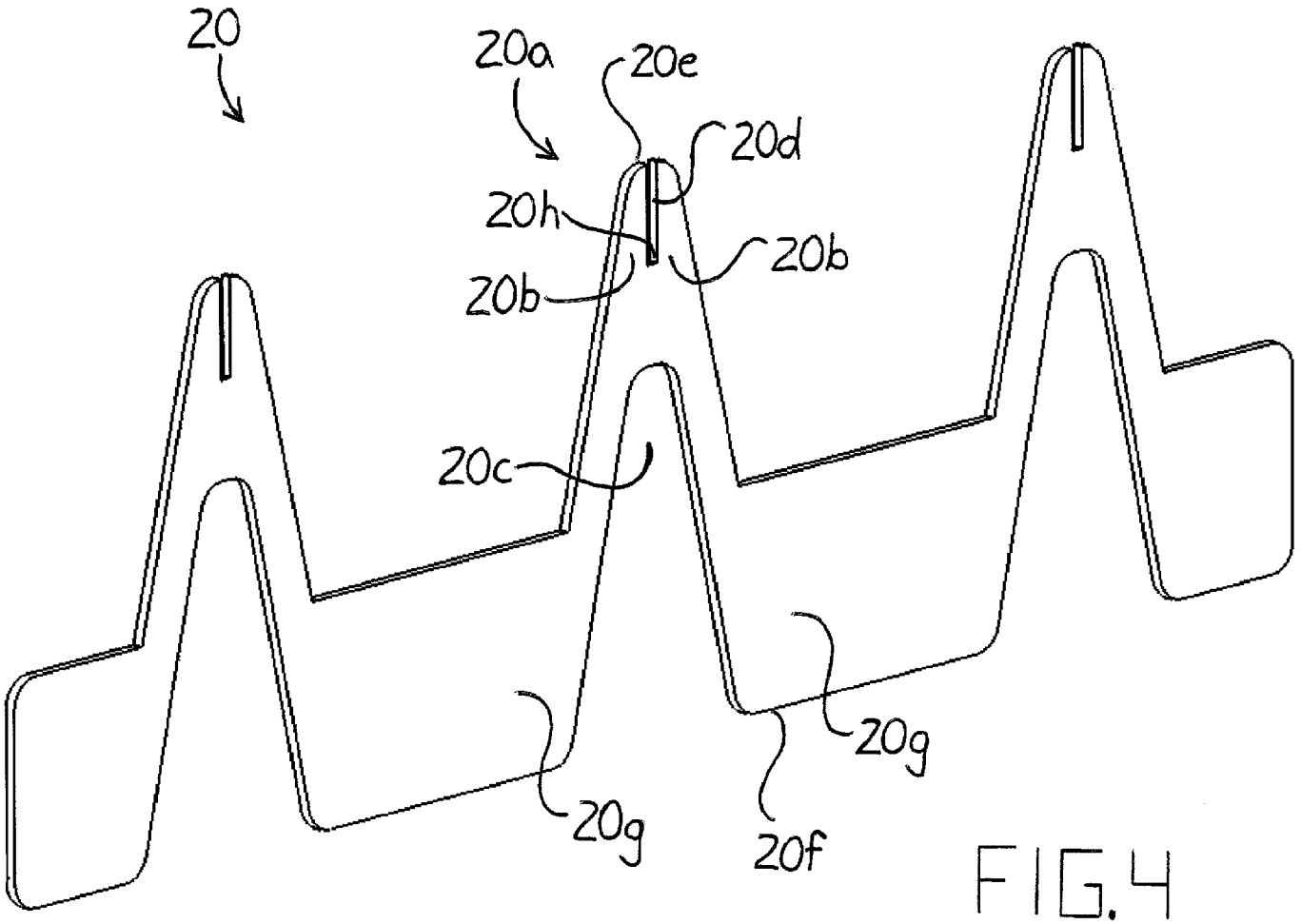
FIG. 4 is a perspective view of a second frame member of the modular furniture system.

In the illustrated embodiment, the base frame 12 is made up of two identical sections 12*a*, 12*b*. As shown in FIG. 2, each section is made up of three first frame members 18 and three second frame members 20. The first frame members 18 are spaced apart, parallel and longitudinally aligned with one another. The second frame members 20 are spaced apart, parallel and longitudinally aligned with one another and are perpendicular to the first frame members 18. Shown in FIGS. 3 and 4 respectively, the first and second frame members 18, 20 are nearly identical. Each first frame member 18 is a plate having the form of three identical and integral sections 18*a* connected end-to-end and each being generally A-shaped. Each A-shaped section 18*a* comprises a pair of legs 18*b* converging upward on opposites sides of any empty space or generally triangular notch 18*c* above which the integral legs 18*b* meet. A linear vertical slot 18*d* projects upward from the notch 18*c* toward, but not reaching, the peak 18*e* of the A-shaped section where the legs 18*b* join. Along a partial length of the legs 18*b* extending upward from the bottom 18*f* of the frame member 18, feet 18*g* project laterally outward from the legs 18*b*. Each second frame member 20 is similar, having three identical and integral A-shaped sections 20*a*, each with legs 20*b* converging upward from feet 20*g* projecting laterally outward therefrom at the bottom edge 20*f* at a distance below the peak of the triangular notch 20*c*. The second frame member 20 differs in that the slot 20*d* does not extend upward from the peak of the notch 20*c*, but rather extends downward from the peak 20*e* of the A-shaped section toward, but not reaching, the notch 20*c*. As shown in the figures, the corners of the plate structured base frame members 18, 20 may be rounded to prevent sharp points.

As shown in FIG. 2, the first and second base frame members 18, 20 intersect at the peaks 18*e*, 20*e* of their A-shaped sections 18*a*, 20*a*. With the elongate plate-shaped first and second members perpendicular to one another, the slots 18*d*, 20*d* of their A-shaped sections are axially aligned and the first member 18 is lowered onto the second member 20 along the slot 20*d* thereof until the ends 18*h*, 20*h* of the two engaging slots 18*d*, 20*d* contact to prevent further relative sliding between the two base frame members. The lengths of the slots 18*d*, 20*d* are such that when the first and second frame members 18, 20 are fully engaged by their cooperation, the peaks 18*e*, 20*e* of the frame members 18, 20 are at generally the same height. As the first and second base frame members 18, 20 are identical except for the slots 18*d*, 20*d*, the inter-member spacing of the set of first members 18 is the same as that of the set of second members 20. The intersection of a first frame member 18 with a second frame member 20 at the engaging slotted A-shaped sections 18*a*, 20*a* thereof defines a respective one of the projections 16 in the two dimensional array. The upward angling of the legs 18*b*, 20*b* of the A-shaped sections from the feet 18*g*, 20*g* engaging the ground surface on which the base is assembled at the bottom edges 18*f*, 20*f* means that these legs project upward from the rest of the base frame 12 to form tapered projections narrowing in the upward direction. The perpendicular intersection of the base frame members 18, 20 gives these tapered projections 16 a cross-shaped cross section.

As shown in FIG. 2, the base frame section 12*a* resulting from the engagement of frame members 18, 20 of equal length in the grid defining fashion described above is square in plan. However, for use in assembling an elongate piece of furniture as shown in FIG. 1, the two identical base frame sections 12*a*, 12*b* are simply coupled together at meeting ends thereof. Additional frame sections may be similarly added to the uncoupled ends or sides of the two sections shown to expand the footprint of the furniture. Alternatively, one of the two sections may be removed to reduce the base to one section to produce a small piece of furniture. Each section rests atop a ground surface at the bottom edges 18*f*, 20*f* of the feet 18*g*, 20*g* so that the plate-like frame members project perpendicularly upward from the ground surface. The perpendicular grid forming engagement of the frame members 18, 20 provides stability despite the relatively narrow bottom edges 18*f*, 20*f* on which the structure stands.

Figure 5:
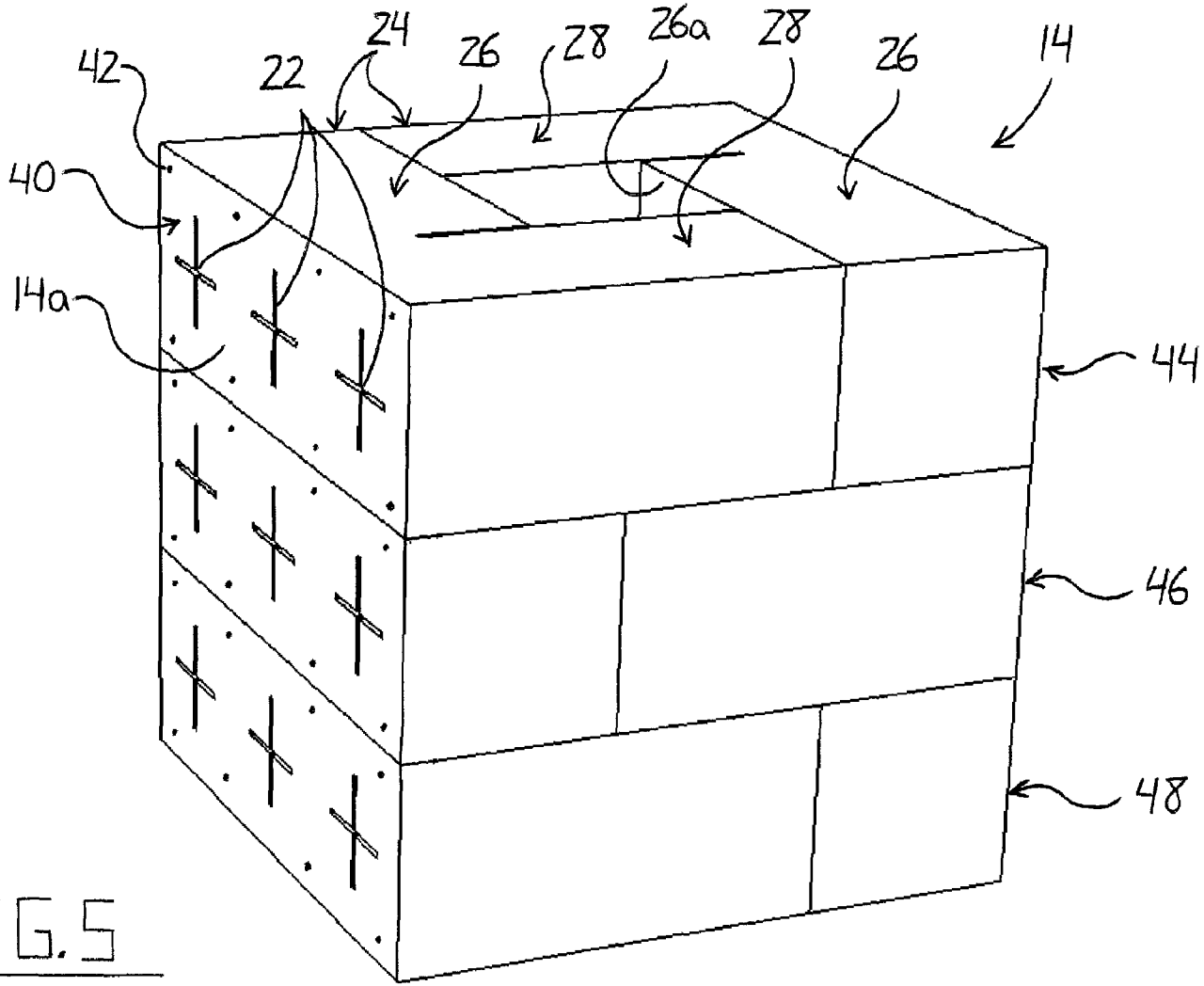
FIG. 5 is a perspective view of support-surface components of the modular furniture system arranged in a stacked storage configuration for transport.

Looking at FIG. 5, in which the plurality of support-surface components are shown grouped together and stacked into a compact storage configuration, three slots 22 extend into each of the plurality of components from a bottom face thereof (bottom referring to the lowermost face when the component is engaged to the base 12, not the lowermost face in the storage configuration of FIG. 5). Each slot 22 has a cross-shaped cross section to receive the cross-shaped cross section of the projections 16 of the base 12 formed by the intersection of the perpendicular base frame members 18, 20. The slots 22 are linearly spaced along the bottom face with two of the four branches of each cross-shaped slot lying on a central longitudinal axis of the bottom face. The use of the right-angle cross-shaped cross section for the projections 16 and slots 22 ensures that when one of the plurality of support-surface components 14 is lowered into engagement with the base 14, it will extend parallel to either a row or a column of the two-dimensional rectangular array of projections 16 in which the projection sliding into the slot lies. This cross section also allows the component to extend in either direction along the row or column from the projection to which it is engaged. As all the projections 16 are identical, as are the slots 22, the user thus has the ability to select from a number of various positions or orientations for a component relative to the base 12. This particular cross section also blocks significant relative rotation of a slot and a projection engaged therein. In the illustrated embodiment, relative rotation of a component about a projection axis is prevented anyhow the engagement of each component with multiple projections. The peaks 18*e*, 20*e* of the frame members 18, defining the projections 16 are rounded or flattened so that the components do not sit atop a sharp point. The bottom surfaces of the components rest on or just above the top edges of the feet 18*g*, 20*g* projecting from the legs 18*b*, 20*b* of the A-shaped sections of the frame members 18, 20 when the components are slid onto the projections 16.

It should be appreciated that base frames of alternate collapsible structure may be used to provide an array of projections upon which components may be mounted in various positions and orientations and that straight-edged cross sections other than the cross-shape may similarly prevent relative rotation between a projection and the slot engaged thereabout. However, such shapes may not be able to allow selective alignment with a row or column or may not be able to restrict orientation of the component about the projection axis to alignment with a row or column. For example, similar triangular cross sections for the projections and slots would prevent rotation once engaged, but as the sides of a triangle are not perpendicular, a user would be limited to possible alignment with only a row or only a column of the rectangular array. Square cross sections would ensure alignment and allow orientation along a row or column. Octagonal cross sections would allow orientation along a row or column, but would not automatically ensure alignment therewith by mere sliding of the slot over the projection. Also, the cross-shaped cross section can be provided using the easy to manufacture, easy to assemble, easy to disassemble and tightly packing flat plate frame members 18, 20.

As shown in FIG. 1, the illustrated embodiment features four L-shaped components 24, each comprising a cylindrical base portion 26 of rectangular cross section and a projecting cylindrical portion 28 also of rectangular cross section projecting perpendicularly from an end of the base portion 26. When the slots 22 in the bottom face of the component are lowered into engagement with projections 16 of the base 12, the base portion 26 of the L-shaped component 24 extends along a base frame member and the projecting portion 28 projects upward away therefrom. A top face 28*a* of the projection portion 28 distal to the base portion 26 is thus elevated above a top face 26*a* of the base portion opposite the bottom face 24*a* of the component from which the slots 22 extend thereinto. The plurality of support-surface components 14 is completed by two cylindrical components of rectangular cross section, a short rectangular component 30 and a tall rectangular component 32. The short rectangular component 30 has a height equal to that of the base portion 26 of each L-shaped component 24 so that a top face 30*a* of the short rectangular component 30 is flush with the top face 26*a* of the base portion when the components are engaged to the base 12. The tall rectangular component 32 has a height equal to that of each L-shaped component 24 so that a top face 32*a* of the tall rectangular component 32 is flush with the top face 28*a* of the projecting portion 28 when the components are engaged to the base 12.

Figure 9:
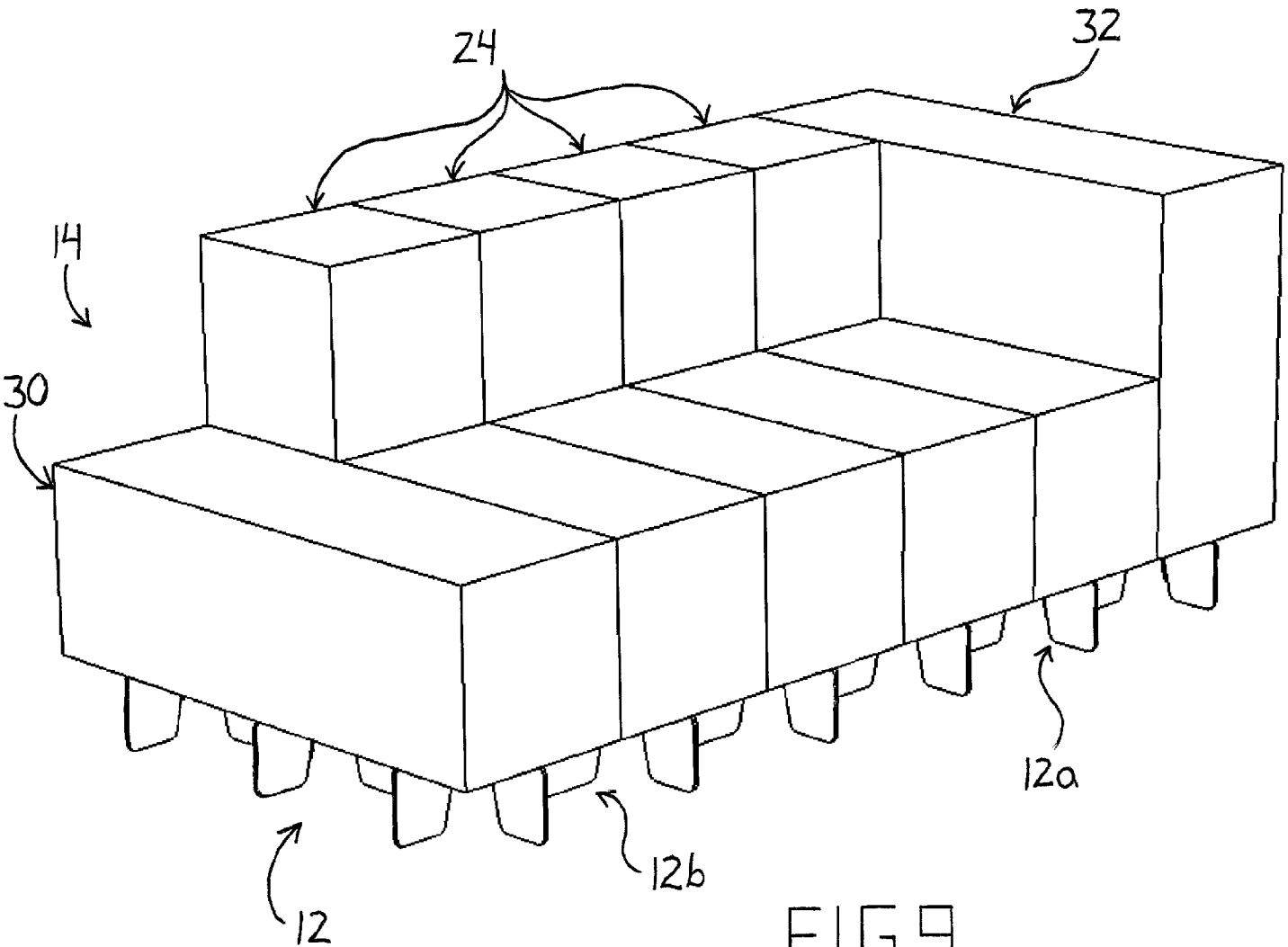
FIGS. 9 to 14 are perspective views of the modular furniture system with the support-surface components arranged in various configurations to alter the overall shape of the piece of furniture defined by the system.

FIG. 9 shows the same view as FIG. 1, but with the plurality of components 14 having been lowered into engagement with the base 12 with each component extending along a respective row of the rectangular two-dimensional projection array, or in other words, widthwise across the base along a respective one of the frame members. The piece of furniture defined with the tall rectangular component 32 and short rectangular component 30 at opposite lengthwise ends of the base with the L-shaped components 24 between them may be considered to be a one-armed sofa. The top face 32*a* of the tall rectangular component 32 defines the one arm rest at one end and the projecting portions 28 of the L-shaped components 24 define a back of the sofa extending toward the opposite end from the arm rest. The top faces 26*a* of the base portions 26 of the L-shaped components 24 and the top face 30*a* of the short rectangular component define a seating surface upon which a person may sit, lie or otherwise rest.

Figures 6, 7A, 7B:
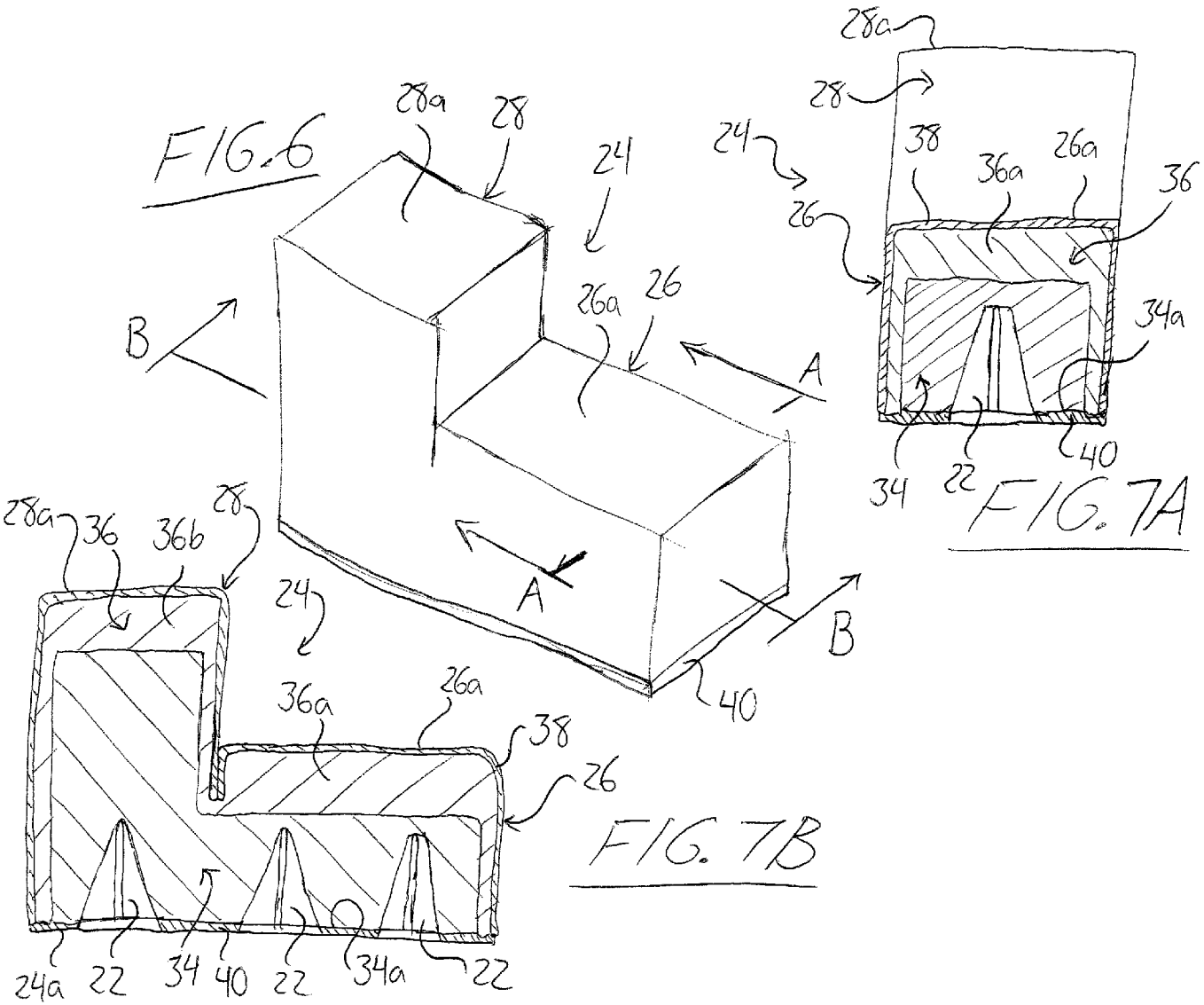
FIG. 6 is a perspective view of cross section of an L-shaped support-surface component of the modular furniture system.
FIG. 7A is a cross sectional view of the L-shaped support-surface component as taken along line A-A of FIG. 6.
FIG. 7B is cross sectional view of the L-shaped support-surface component of the modular furniture system as taken along line B-B of FIG. 6.

FIGS. 6 and 7 illustrate the structure of the L-shaped components of the illustrated embodiment. Each component includes three separable layers. An L-shaped core 34 of rotationally molded plastic defines the main body of the L-shaped component 24. Molded or otherwise shaped foam provides a padding layer 36 immediately surrounding the core 34 on all sides thereof except for being left open over a bottom face 34*a* thereof. The padding layer 36 is thicker along the top surfaces 26*a*, 28*a* of the base and projecting portions 26 of the L-shaped component 24, 28 to increase a cushioning effect at these thicker areas 36*a*, 36*b* which are potentially used to define seating surfaces and armrests. Outside the padding layer 26 on a side thereof opposite the core 34, is a covering layer 38 of fabric sewn to be form fitting over the core and padding layer 36 to shroud them, except for likewise being open at the bottom surface 34*a* of the core 34. As shown in FIGS. 5 to 7, a panel or plate 40 may be secured to the bottom surface 34*a* of the core 34 to define the bottom surface 24*a* of the component, the slots 22 extending through the panel 40 into the core 34. The panel 40 reinforces the opening of each slot to prevent wear and damage to the core 34 when lowering the component onto a projection 16 of the base 12 and is secured to the core using fasteners 42, such as screws threaded into the core through the plate 40.

Each being open at the bottom face 34*a* of the core 34, the padding layer 36 and the covering layer 38 each have a slip-cover structure which allows easy installation and removal of one or both of the layers, which are not fastened together and thus are completely separable. The padding layer 36 is simply slipped over the core 34 with the covering layer 38 then being slipped over the core and padding combination. This allows easy replacement of the layers, either together or separately, when desired by the owner, for example in response to significant wear of one or both layers or to change the appearance of the components by replacing the covering layer with fabric of another color or pattern. As the cores and a base made of metal or other strong durable reliable material should last an extremely long time, the life of the modular furniture system may be extended simply by replacing the padding and covering in response to wear. The replacement of these layers also increases the owner's ability to change the appearance of the furniture defined by the system.

The covers for the rectangular components are similar to those for the L-shaped components with a hollow interior and open end, except they have a more simplistic rectangular shape due to the lack of a projecting portion. This lack of a two tier structure with two distinct upper surfaces at different heights also means that only a single thicker portion of padding is provided, along the unitary upper surface of the rectangular component.

It should be appreciated that the modular furniture system 10 of the present invention need not be limited to use as a sofa, or even limited to particular use as a seating system. Indeed the modular furniture system may be used to provide support surfaces for purposes other than seating, and therefore may define such things as a table, a stand, or an entertainment center and should not be limited to in-home use. Where the system is not intended for seating use, the thicker portions 36*a*, 36*b* of the padding layer, or even the entire padding layer, may not be necessary. Even when not used for seating, the use of an outer covering layer however does allow quick and easy changing of pattern or color. The components used to define support surfaces arrangeable atop the base may be of alternate shapes or structure, and alternate materials that may be suitable for use in the modular furniture system will be appreciated by those of skill in the art.

FIG. 5 shows the plurality of support-surface components 14 grouped together in a compact face-to-face configuration including stacking of layers of the components atop one another. The top two layers 44, 46 of the stack are each formed by a pair of the L-shaped components 24 laid on their sides. The top surface 28*a* of the projecting portion 28 of each L-shaped component 24 in one layer mates flush against the top surface 26*a* of the base portion 26 of the other L-shaped component at an end of this top surface 26*a* opposite the distal to the projecting portion of the same component. This defines a rectangular layer having a rectangular opening or hole in the center thereof. The bottom layer 48 of the stack is a rectangular layer of the same outer dimensions formed by the short and long rectangular components 30, 32 laid on their sides with a top or bottom face of one resting flush against the top or bottom face of the other. The resulting stack has a cylindrical periphery and a rectangular cross section. Using FIG. 1 as a reference, all the components have the same length, and the sum of the height of an L-shaped component and the height of a base portion of another L-shaped component is equal to this common length. All the components also have the same width, which is one third of the common length. Comparing this information to the stacked arrangement of the components in FIG. 5, the outer shape of the stack defines a cube. The height of the stack (the sum of three component widths from FIG. 1), the depth of the stack (the length of any one component from FIG. 1) and the width of the stack (the sum of the height of one L-shaped component and the height of the base portion of one L-shaped component from FIG. 1) are all equal.

The cube of FIG. 5 is of significantly less volume than a rectangular box needed to enclose the plurality of components 14 when in the sofa-defining configuration shown in FIG. 9, due to the empty space shown in FIG. 9 above the seat-defining surfaces 26*a*, 30*a* but below the armrest and back defining surfaces 28*a*, 32*a*. Having the components groupable into this reduced volume configuration makes the system easer to handle and less costly to transport and reduces fuel consumption by helping reduce empty volume within shipping containers, thereby increasing the number of articles transportable at one time in a single transport vehicle. As shown in FIG. 9, the flat plate-like frame members used to form the grid-like frame 12 each have a length not exceeding that of the support-surface components, and so a box or container only slightly larger in one dimension than the cube-like stack of the components in the transport configuration can also contain the frame members.

Figure 8:
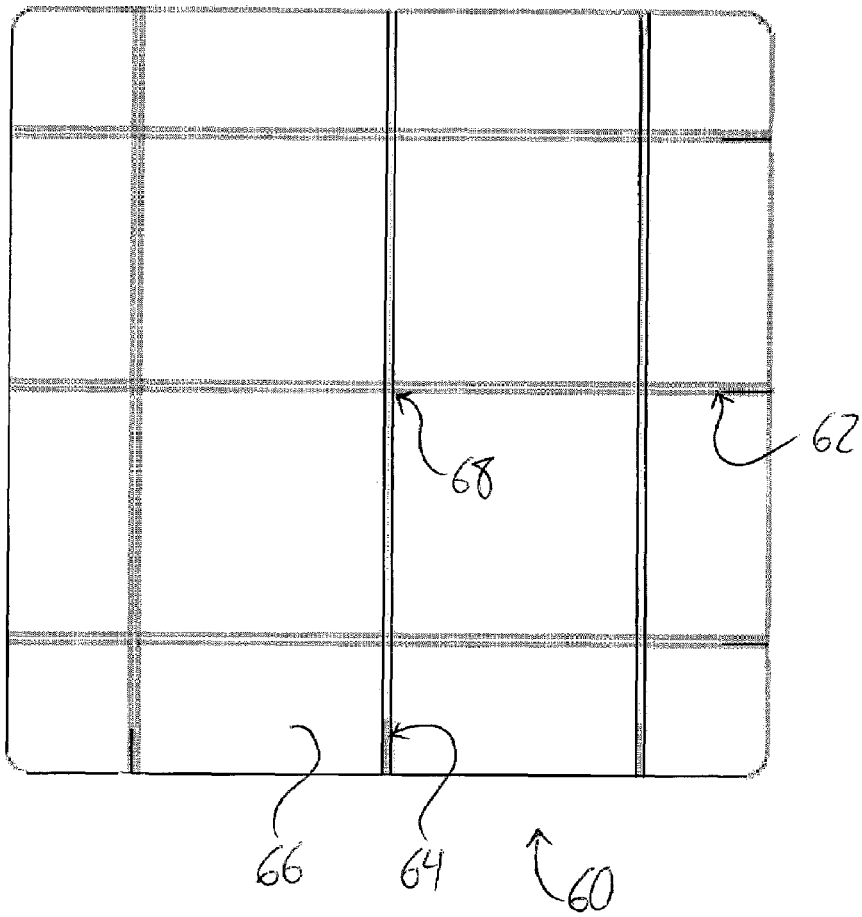
FIG. 8 is a bottom plan view of a tabletop support-surface component of the modular furniture system.

FIG. 8 shows a tabletop component 60 of the modular furniture system formed of a square plate having an area generally equal to that of one of the base frame sections 12*a*, 12*b*. Two sets of three spaced apart parallel grooves 62, 64 are formed in a bottom surface 66 of the plate with the two sets arranged perpendicular to one another to form a grid pattern having the same dimensions as the grid or array defined by the base 12. In other words, each intersection 68 of two perpendicular grooves 62, 64 aligns with a projection 16 of the base when the tabletop 60 is lowered onto a three-by-three portion of the array of projections 16 such that the periphery of the tabletop 60 is generally aligned with the periphery of this square portion of the array. The tabletop 60 can be engaged atop the base 12 in place of three adjacent L-shaped or rectangular components to form a table portion of the piece of furniture. The cross-shaped projections 16 extend upward into the cross-shaped recesses formed at the intersection of the grooves 62, 64 in the bottom surface of the tabletop component 60, like the slot and projection cooperation of the L-shaped or rectangular components 24, 30, 32 with the base 12, to prevent movement and rotation in the plane in which it rests atop the base 12. The perpendicular intersecting grooves 62, 64 provide a cross-shaped slot at each intersection 68, but it should be appreciated that the full length grooves 62, 64 extending fully across the tabletop 60 may be replaced with cross shaped recesses at positions thereon corresponding to the groove intersections, thereby creating a three-by-three two dimensional rectangular array of cross-shaped slots or recesses centrally located in the bottom surface 66 of the plate rather than a full grid pattern spanning the entire tabletop surface.

The tabletop component 60 may be opaque, transparent or translucent and may be made from a number of suitable materials known to those of skill in the art, including metals, plastics and glass. Similar to the removable replaceable covers of the L-shaped and rectangular support surface components, substitution of one tabletop component for another allows a user to easily change the appearance of the piece of furniture, not only be changing relative positioning of the various components on the base, but also by substituting tabletop components of different materials, colors, patterns or slot-forming arrangements (i.e. a full grid pattern versus unconnected cross-shaped recesses). The tabletop has generally the same dimensions as a face of the stacked cube in FIG. 5, and so can be easily incorporated into the same package as the stacked cube of cushioned components and the unassembled frame members 18, 20 with minimal increase in package volume.

FIGS. 9 to 14 show support surface components, chosen from among the L-shaped, rectangular and tabletop components 24, 30, 32 and 60, engaged atop the base in different positions and orientations relative to one another, thereby forming different furniture configurations.

FIG. 9 shows the modular furniture system 10 used to define a sofa-like piece of furniture having one arm rest and a backless open end opposite the end with the arm rest. This configuration uses both base frame sections 12*a* and 12*b* and has each of the plurality of components 14 extending cross-wise to the frame to engage a respective row of projections.

Figure 10:
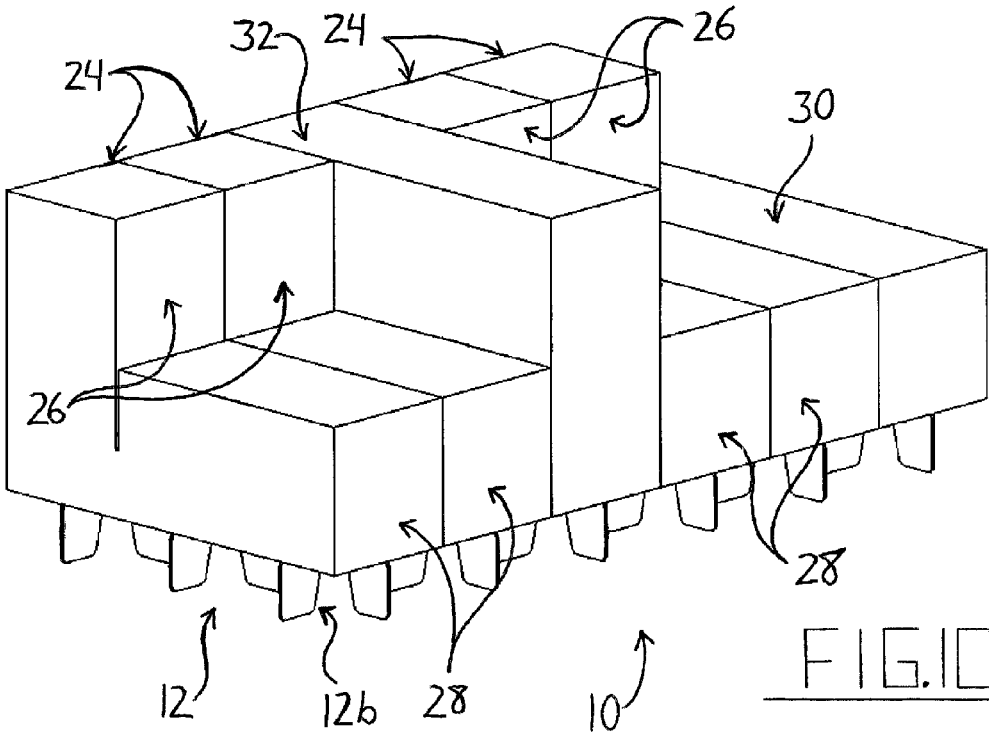

FIG. 10 shows the modular furniture system 10 used to define a two-seat piece of furniture in which a pair of L-shaped components 24 defines one back-equipped seat on a first side of the tall rectangular component 32. A second seat is defined on an opposite side of the tall rectangular component 32 by two adjacent L-shaped components 24 adjacent the tall rectangular component and the short rectangular component 30 adjacent the two L-shaped components on a side thereof opposite the tall rectangular component 32. Each component extends cross-wise to the frame to engage a respective row of projections and the L-shaped components are oriented in the same direction so that their projecting portions 26 define backs of the two seats along a common side of the frame 12. The short rectangular component 30 extends the seating surface of the second seat passed the back-equipped portion define by the L-shaped components to the respective end of the furniture piece.

Figure 11:
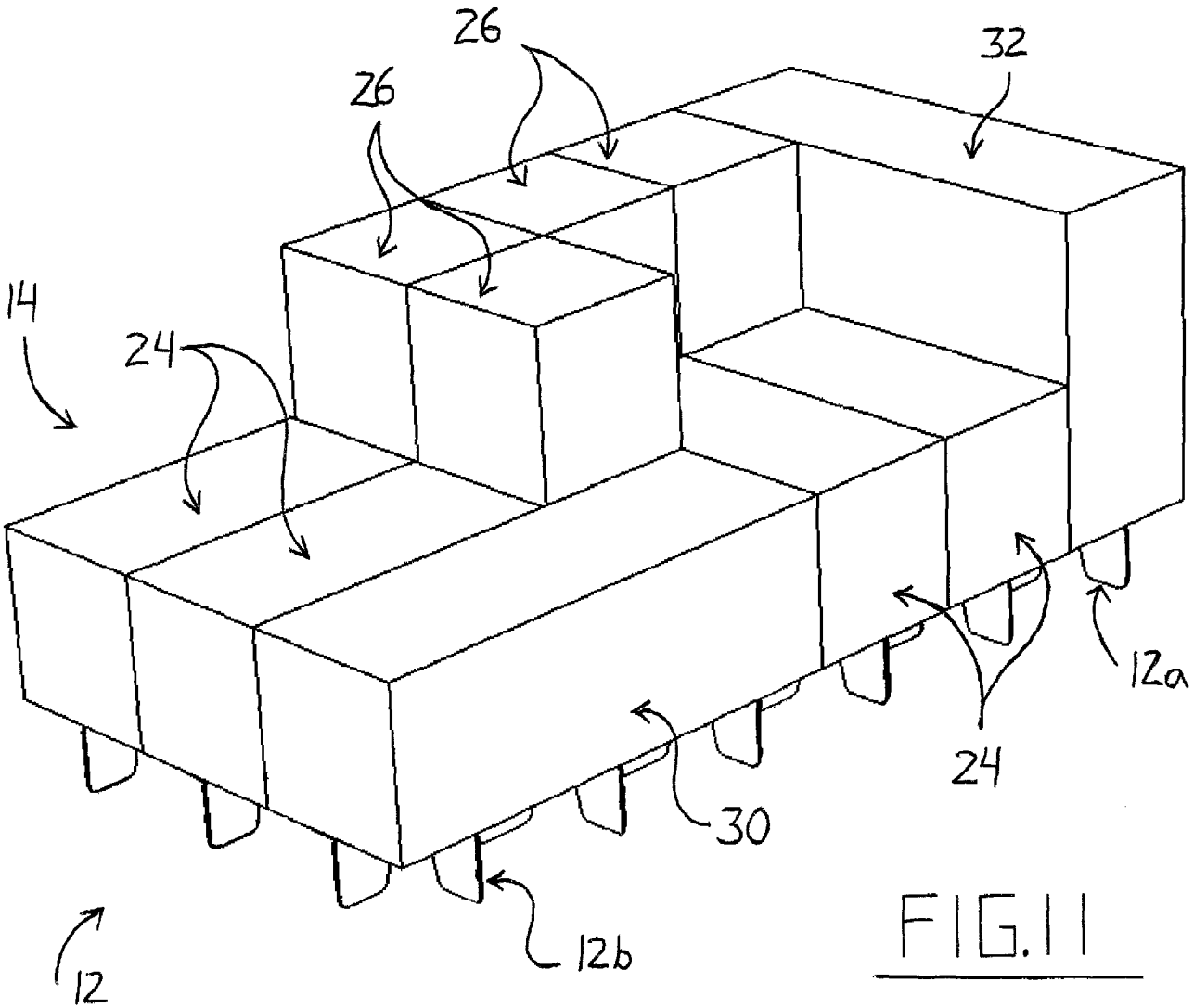

FIG. 11 shows the modular furniture system 10 used to define another two-seat piece of furniture. Unlike the configuration described above, here some of the plurality of components 14 extend cross-wise to the frame along a respective row, while others extend lengthwise along columns of the frame. At one end, the tall rectangular component 32 defines an armrest of the first seat, the remainder of which is formed by two adjacent L-shaped components 24 filling the remainder of the first base frame section 12*a* having their projecting portions 26 define a seat back along one side of the frame. The second seat has two adjacent L-shaped components 24 projecting laterally from the first seat at the back-defining end thereof. The short rectangular component 30 extends parallel to these laterally projecting L-shaped components from an end of the first seat opposite the back thereof defined by the projecting portions of the first seat's L-shaped components. A person may sit on the second seat facing the same direction as someone sitting in the first seat, or may face an opposite or lateral direction relative thereto, the projecting portions of the second seat L-shaped components defining either a seat back or arm rest depending on what direction the seated person chooses to face. The projecting portion of the L-shaped component in the middle of the second seat also defines a partial armrest of the first seat.

Figure 12:
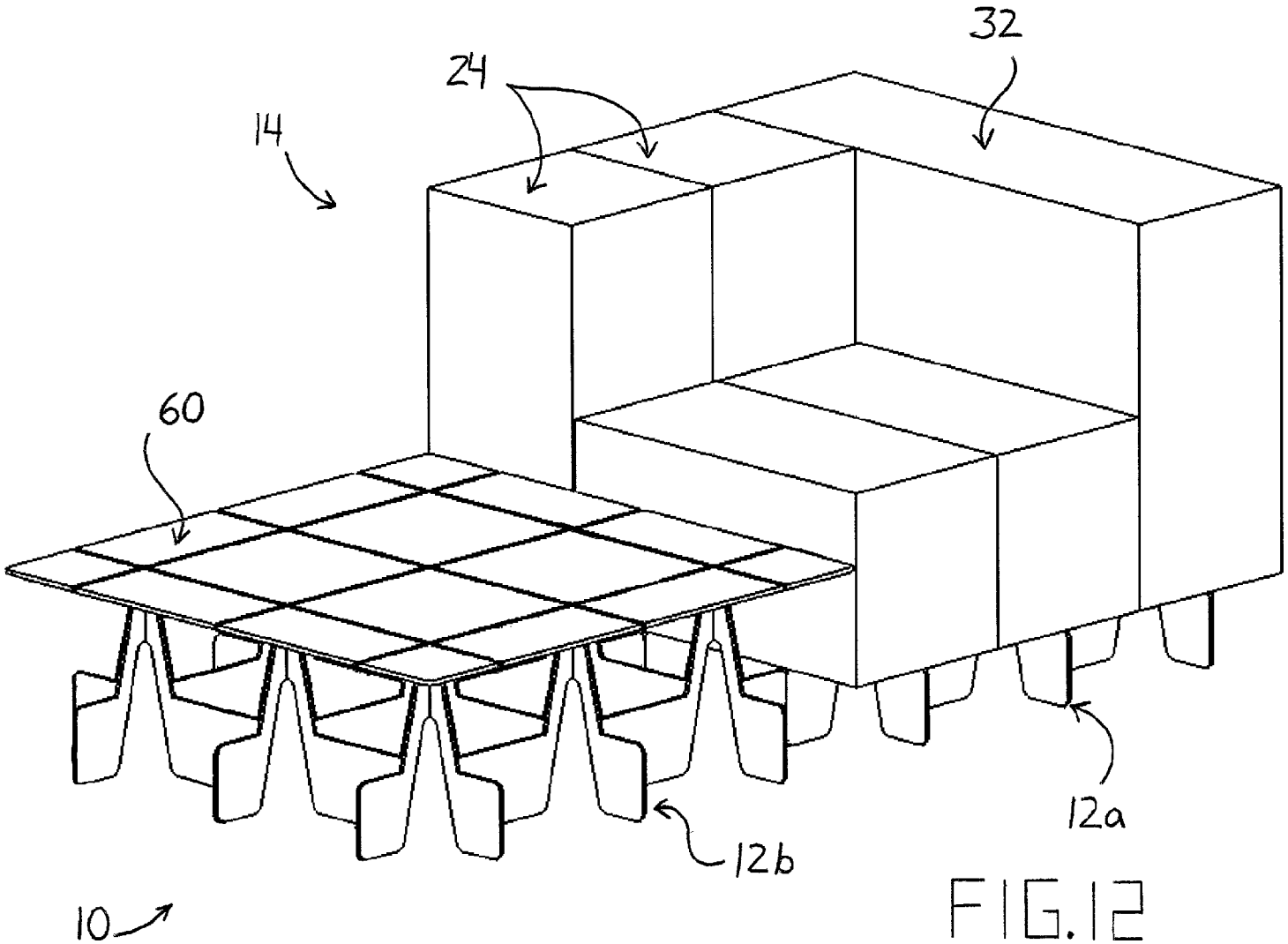

FIG. 12 shows the modular furniture system 10 used to define a seat and table piece of furniture. At one end, a seat is defined on the first base frame section 12*a* in the same manner as the first seat of the configuration shown in FIG. 11 and described above. On the second base frame section 12*b*, the tabletop component 60 is engaged atop the projections thereof to define a table immediately adjacent the seat.

Figure 13:
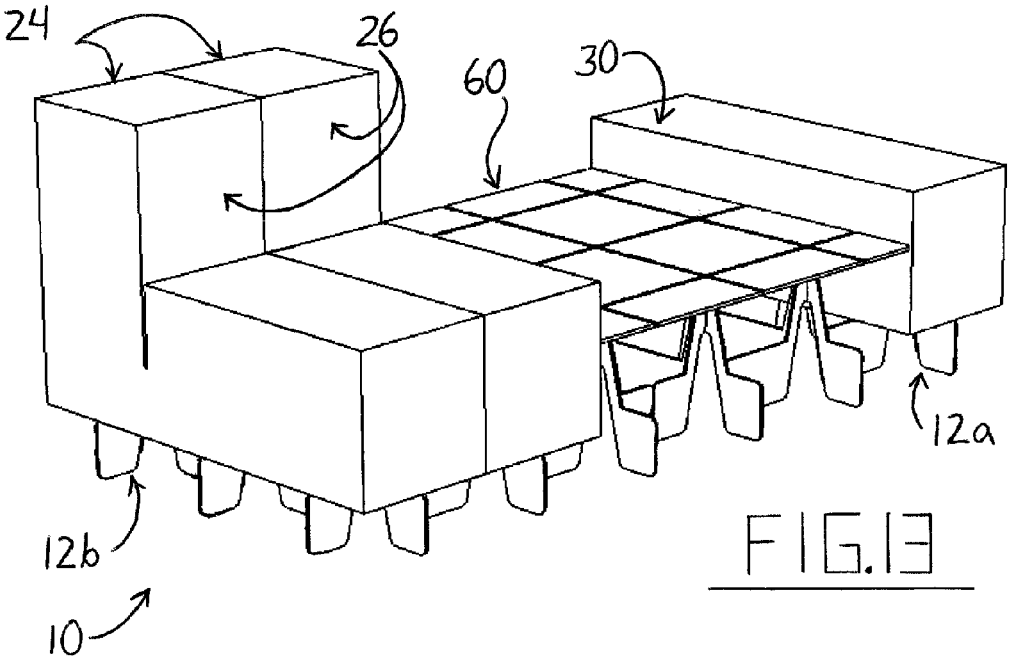

FIG. 13 shows the modular furniture system 10 used to define another seat and table piece of furniture. Here a back-equipped armless seat is defined at one end by two adjacent L-shaped components 24 extending cross-wise to the frame along a row of projections. The tabletop component 60 overlies the adjacent three rows, i.e. the remaining row of the second base frame section 12*b* and two of the three rows of the first base frame section 12*a*. At the other end of the furniture piece along the remaining unused row of the first base frame section 12*a*, the short rectangular component 30 is disposed to define a narrow, flat cushioned seat or other support surface.

Figure 14:
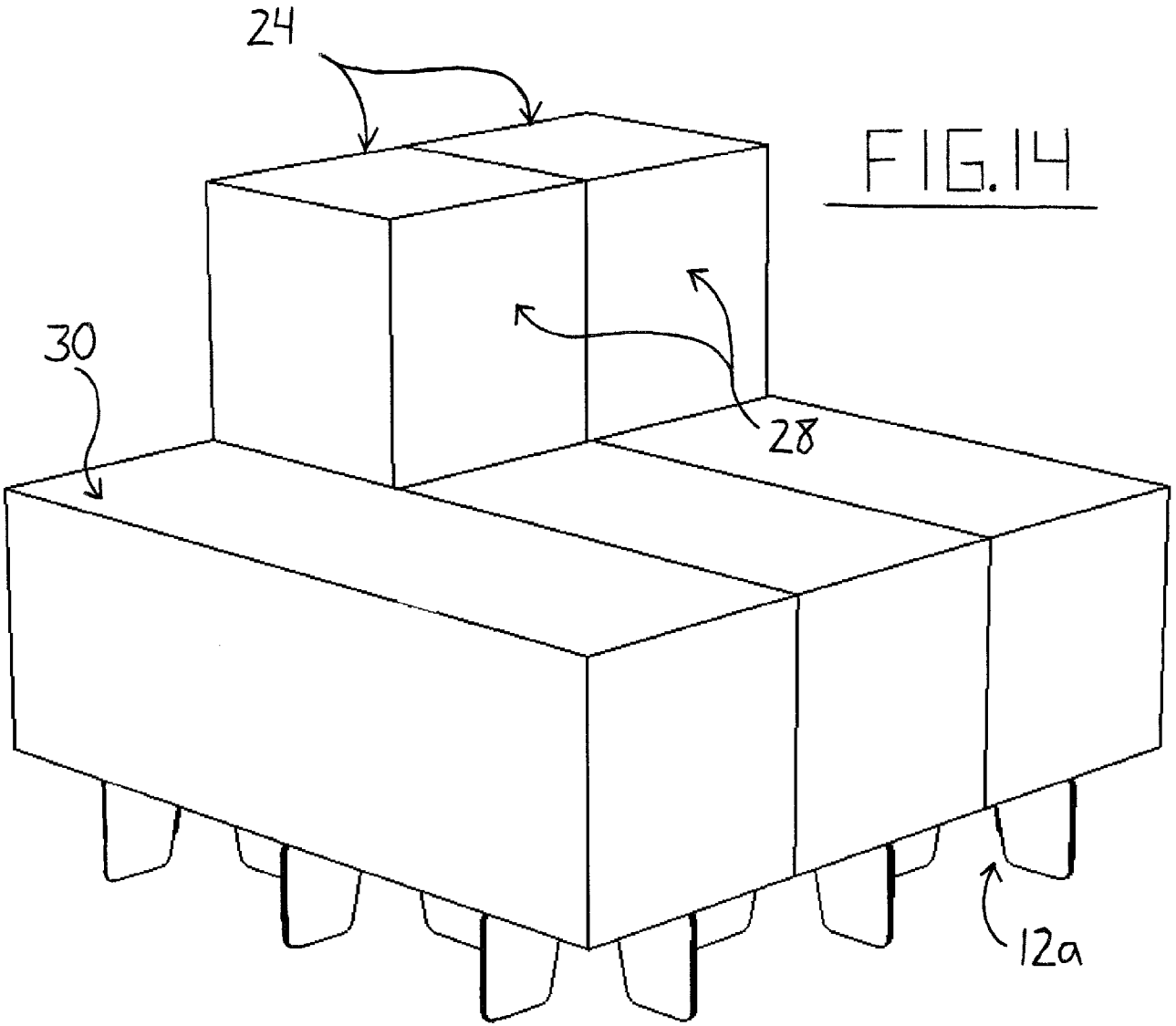

FIG. 14 shows use of only the first base frame section 12*a*, with the other section uncoupled therefrom either for use elsewhere to define a second pieces of furniture or disassembled into its flat frame members 18, 20 for compact storage. Three components are used to define a single seat atop the first base frame section 12*a*. The three parallel components include two adjacent L-shaped components 24 oriented in the same direction and the short rectangular component 30 parallel and adjacent thereto. The two projecting portions 26 of the L-shaped components 24 define either an arm rest or seat back depending on where the user chooses to sit and what direction he/she chooses to face.

FIGS. 9 to 14 show the adaptability provided by the modular furniture system to allow for changes in shape in response to a desired change in appearance or function. In the illustrated embodiment, each component is about 30 inches long and 10 inches wide. The L-shaped components and the tall rectangular components are about 20 inches high, with the short rectangular component being 10 inches high. The cube into which the L-shaped and rectangular components are stackable due to their flat, perpendicular outer surfaces that can be mated in flush face-to-face arrangements is thus about 30 inches by 30 inches by 30 inches. The frame members 18, 20 are about 30 inches long with the projections formed thereby when assembled being about 10 inches apart center-to-center along each row or column in the array formed. As the L-shaped and rectangular components are 10 inches wide and mounted centered on the projections, adjacent components thus fill the space between the projections of the array. The padding layer and cover are about 4 inches thick at the thicker padding areas, and are about 0.5 inches thick elsewhere. The cores are thus about 9 inches wide, about 6 inches and 16 inches high at the base portions and projecting portions respectively of the L-shaped components, about 6 inches high in the short rectangular component and about 16 inches high in the tall rectangular component. The tabletop components is about 30 inches by 30 inches. The entire modular furniture system can thus be shipped in a rectangular container not much larger than 30 inches by 30 inches by 30 inches.

It should be appreciated that the structure, dimensions and shapes of the components and base may be somewhat altered while still providing the adaptable or collapsible advantageous of the present invention. For example, the number of slots provided in each component does not necessarily need to equal the width of the array of projections, as smaller components of different shapes may be used to increase the number of potential configurations.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A modular furniture system comprising:

a frame adapted to define a plurality of engagement sites; and a plurality of components removably engagable to the frame at the plurality of engagement sites to define a piece of furniture, each component being engagable to the frame at different positions thereon to facilitate a change in shape of the piece of furniture by rearrangement of the plurality of components relative to one another;

wherein the frame comprises a plurality of frame members selectively engageable together in a grid formation in which a first series of frame members crosses a second series of frame members, the frame members extending upwardly at spaced apart positions over the grid formation to define, at the engagement sites, projections over which corresponding component slots in the plurality of components are slidable to engage the plurality of components with the frame.

2. The modular furniture system of claim 1 wherein each component is engagable to the frame at different orientations relative thereto.

3. The modular furniture system of claim 1 wherein the frame is adapted to define a two-dimensional array of engagement sites.

4. The modular furniture system of claim 3 wherein the two dimensional array of engagement sites is rectangular and each component is adapted to engage the frame at multiple engagement sites, the multiple engagement sites equaling a row of the two dimensional array in number of engagement sites.

5. The modular furniture system of claim 1 wherein at least some of the plurality of components are each generally L-shaped to define a base portion adapted to extend along the frame when connected thereto and a second portion projecting from the base portion proximate only one end thereof to extend away from the frame when connected thereto, the base portions of the L-shaped components having the component slots formed therein.

6. The modular furniture system of claim 1 wherein at least some of the components comprise cushioned portions to collectively define a seat when connected to the frame adjacent one another.

7. The modular furniture system of claim 1 wherein at least one of the components comprises a tabletop.

8. The modular furniture system of claim 1 wherein the plurality of frame members extend upwardly to intersections between crossing frame members to define cross-shaped projections over which the corresponding component slots in the plurality of components are slidable to engage with the frame.

9. The modular furniture system of claim 1 wherein the plurality of components are removably engagable to the frame at the plurality of engagement sites in a seat-forming configuration to define a seat atop the frame, the plurality of components being shaped and sized to be groupable together into a storage configuration when not engaged to the frame, the plurality of components when in the storage configuration being enclosable in a rectangular volume of lesser size than required to enclose the plurality of components when in the seat-forming configuration.

10. The modular furniture system of claim 9 wherein the plurality of components comprises L-shaped components each having a base portion and a second portion projecting from the base portion proximate only to end thereof, the base portions of the L-shaped components being equal in length and having the component slots formed therein and the second portions of the L-shaped components being equal in length.

11. The modular furniture system of claim 10 wherein each L-shaped component comprises flat sides to facilitate stacking of layers of the L-shaped components.

12. The modular furniture system of claim 10 wherein exterior faces of each component are flat with adjacent ones of the exterior faces being perpendicular to one another to facilitate flush face-to-face arrangement of the components in the storage configuration.

13. The modular furniture system of claim 10 wherein the components are arrangeable into stacked layers in the storage configuration, the stacked layers defining a stack having a periphery that delimits a cubical volume.

14. The modular furniture system according to claim 1 wherein the projections and the component slots are shaped to cooperatively prevent rotation of each component about an axis when said component is engaged with a one of the projections extending along said axis.

15. The modular furniture system according to claim 1 wherein the projections and the component slots are shaped to allow engagement of one of the components onto a respective one of the projections in different orientations of said one of the components relative to said projection.

16. The modular furniture system according to claim 1 wherein the projections are cross-shaped.

17. The modular furniture system according to claim 16 wherein the cross-shaped projections are defined by intersection of crossing frame members in the grid formation.

18. The modular furniture system according to claim 1 wherein the frame members have frame slots therein to facilitate engagement of crossing first and second frame members together by sliding the first frame members into a respective frame slot in the second frame member.

19. The modular furniture system according to claim 18 wherein each frame member, at spaced apart locations therealong, has a pair of upwardly extending and upwardly converging legs joined together at a planar connection above a remainder of the frame member, first frame slots extending downward into the connections of the first frame member from above peaks thereof and second frame slots extending upward into the connections of the second frame member from between the legs thereof such that sliding one of the first frame slots in a respective one of the second frame slots into end-to-end engagement therewith with the first and second frame members crossed defines a respective one of the projections.

* * * * *